US011219272B1

(12) United States Patent
Lee

(10) Patent No.: US 11,219,272 B1
(45) Date of Patent: Jan. 11, 2022

(54) INSOLE FOR ERGONOMIC SHOES

(71) Applicant: FROMYITH INC., Daegu (KR)

(72) Inventor: Tae Hyung Lee, Daegu (KR)

(73) Assignee: FROMYITH INC., Daegu (KR)

( * ) Notice: Subject to any disclaimer, the term of this patent is extended or adjusted under 35 U.S.C. 154(b) by 0 days.

(21) Appl. No.: 17/466,617

(22) Filed: Sep. 3, 2021

Related U.S. Application Data

(63) Continuation of application No. PCT/KR2019/012986, filed on Oct. 4, 2019.

(30) Foreign Application Priority Data

Oct. 4, 2019 (KR) ..... 10-2019-0122752

(51) Int. Cl.

| | |
|---|---|
| ***A43B 17/14*** | (2006.01) |
| ***A43B 17/02*** | (2006.01) |
| ***A43B 7/14*** | (2006.01) |
| ***A43B 17/00*** | (2006.01) |
| ***A43B 7/32*** | (2006.01) |

(52) U.S. Cl.
CPC ..... *A43B 17/00* (2013.01); *A43B 7/32* (2013.01)

(58) Field of Classification Search
CPC ..... A43B 17/00; A43B 17/02; A43B 17/18; A43B 1/0009; A43B 7/32
See application file for complete search history.

(56) References Cited

U.S. PATENT DOCUMENTS 5,067,256 A * 11/1991 Darby ..... A43B 23/16 36/69
5,329,705 A * 7/1994 Grim ..... A43B 1/0009 36/110
6,178,662 B1 * 1/2001 Legatzke ..... A43B 13/20 36/3 R
8,201,346 B2 * 6/2012 Darby, II ..... A43B 7/28 36/76 R
10,561,197 B2 * 2/2020 Darby, II ..... A43B 7/1405
10,939,723 B2 * 3/2021 Walborn ..... A43B 7/141
2004/0045195 A1 * 3/2004 Long ..... A43B 7/1465 36/88

(Continued)

FOREIGN PATENT DOCUMENTS

JP H07039511 U 7/1995
KR 200290595 Y1 10/2002

(Continued)

OTHER PUBLICATIONS

International Search Report of PCT/KR2019/012986 dated Jun. 29, 2020.
Office Action of KR 10-2019-0122752 dated Jun. 16, 2020.

*Primary Examiner* — Jila M Mohandesi
(74) *Attorney, Agent, or Firm* — Dinsmore & Shohl LLP; Yongsok Choi, Esq.

(57) ABSTRACT

An insole for ergonomic shoes according to an embodiment of the present disclosure, including: a plurality of first polygonal grooves that are formed to be arranged in polygonal shapes on a lower surface of the insole; a first wall portion forming a rim of the first polygonal groove; and a second polygonal groove that is disposed in a pressure distribution portion, which is a part of an inner and lower surface of the insole, and is formed of a rim including a second wall portion having a height lower than a height of the first wall portion.

6 Claims, 5 Drawing Sheets

(56) References Cited

U.S. PATENT DOCUMENTS

| | | | | |
|---|---|---|---|---|
| 2008/0201992 | A1* | 8/2008 | Avar | A43B 13/184 36/25 R |
| 2012/0317843 | A1* | 12/2012 | Bove | A43B 1/0054 36/25 R |
| 2017/0135439 | A1* | 5/2017 | Davis | B29D 35/142 |
| 2018/0332926 | A1* | 11/2018 | Kramer | A43B 17/02 |

FOREIGN PATENT DOCUMENTS

| | | | |
|---|---|---|---|
| KR | 100647108 | B1 | 11/2006 |
| KR | 101033522 | B1 | 5/2011 |
| KR | 1020110094777 | A | 8/2011 |
| KR | 1020140104207 | A | 8/2014 |

* cited by examiner

INSOLE FOR ERGONOMIC SHOES

CROSS-REFERENCE TO RELATED APPLICATIONS

This application is a continuation of International Application No. PCT/KR2019/012986 filed on Oct. 4, 2019, which claims priority to Korean Patent Application No. 10-2019-0122752 filed on Oct. 4, 2019, the entire contents of which are herein incorporated by reference.

TECHNICAL FIELD

An insole for shoes of the present disclosure relates to an insole for shoes, and shoes for improving the comfort of walking by distributing a load concentrated on a back portion of a sole of a shoe wearer.

BACKGROUND

The foot is the organ in the human body for walking and is an important portion of the human body, which comes into contact with a ground and supports the body during walking or exercise, and a person wears shoes to protect the feet outdoors.

During wearing the shoes, an insole, which serves as height adjustment or a cushion for impact absorption, is usually laid on an inner bottom surface of the shoe.

Since a function of the shoe is limited to simply protecting the foot from the outside, in a case where the insole is not laid thereon, the sole comes into contact with the ground and the impact is transmitted to the foot through the sole, thereby making the foot gets tired easily.

In addition, if the shoe does not have the insole, sweat from the foot can cause the shoe to stink. Therefore, it is common to wear the shoe after laying the insoles inside the shoe, and the insole, which comes into contact with the sole of the foot in a state of wearing the shoe, alleviates the impact that occurs during walking, thereby protecting the foot of the wearer and minimizing fatigue.

Recently, functional insoles, which have various functions such as a fatigue recovery function, a health promotion function, a special treatment function, and an odor removal function in addition to basic functions such as height adjustment and impact absorption, have been provided.

For example, there is an insole in which protrusions or a stimulation portion is formed on an upper surface of a specific portion thereof to allow acupressure on the sole of the foot, or an insole in which holes are formed to give air permeability, thereby reducing the generation of odor to a minimum.

In addition, there have been several attempts to improve a material, a structure, or the like in terms of protecting the foot and absorbing impact, among the functions of the insole, and an insole among them, which absorbs impact by forming a honeycomb structure, has been provided.

For the insole formed with such a honeycomb structure, there is an insole for shoes having cushioning means of a hexagonal multi-cell type in Korean Registered Utility Model Publication No. 20-0290595. In the insole for shoes having the cushioning means of the hexagonal multi-cell type, hexagonal holes are formed in the insole made of a basically impact absorbing material so that walls between the holes form a honeycomb structure. As described above, the insole provided with the cushion portion of the hexagonal multi-cell having the honeycomb structure has been used.

When the wearer wears the shoe after laying the insole on the inside of the shoe, an impact absorbing layer is created in a space filled with air while the inside of the honeycomb structure, that is, the inside of the cell is filled with air, and thereby it has an effect that the wall of the honeycomb structure, which comes into direct contact with the sole of the foot, distributes the impact. Such a honeycomb structure may be formed over an entire area of the insole or formed partially.

In addition, a structure in which a separate insole made of an impact-absorbing material is additionally stacked and fixed on the insole of the honeycomb structure is also provided. In such a structure, as the separate upper insole is stacked on the lower insole of the honeycomb structure, a function is provided for absorbing the impact by air with which the inside (inside the cell) of the honeycomb structure is filled, and distributing the impact by the wall of the honeycomb structure between the upper and lower insoles.

Here, a number of holes may be formed in the upper insole, but the air layer does not absorb sufficiently the impact in the insole for shoes, so that there is a drawback that the effect is insufficient in terms of impact absorption.

In addition, as the insole deteriorates and the honeycomb structure easily collapses, the effect of distributing the impact is significantly lowered, and there is little elasticity in air with which the inside of the cell is filled, and thereby the functionality is greatly reduced.

In addition, in a case where a repetitive load is applied in a certain direction, the load cannot be sufficiently supported, so that there is a problem that the support bodies fall in a direction in which the load is applied or lose a bearing capacity thereof to be deformed in a state of being heated by a high temperature.

SUMMARY OF INVENTION

Technical Problem

An insole for shoes according to an embodiment of the present disclosure is intended to increase the fit by distributing the pressure applied locally to the foot of the shoe wearer.

An insole for shoes according to an embodiment of the present disclosure is intended to provide a strong and comfortable shoe insole by forming a honeycomb structure on the lower surface.

Solution to Problem

According to an embodiment of the present disclosure, there is provided an insole for ergonomic shoes including: a plurality of first polygonal grooves that are formed to be arranged in polygonal shapes on a lower surface of the insole; a first wall portion forming a rim of the first polygonal groove; and a second polygonal groove that is disposed in a pressure distribution portion, which is a part of an inner and lower surface of the insole, and is formed of a rim including a second wall portion having a height lower than a height of the first wall portion.

In the present embodiment, a plurality of the second polygonal grooves may be formed. The rim in the plurality of second polygonal grooves may further include the first wall portion; and a third wall portion that connects the first wall portion and the second wall portion to each other, and has an inclination decreasing from the height of the first wall portion to the height of the second wall portion.

In the present embodiment, a plurality of the second polygonal grooves may be formed. Any one of the plurality of wall portions forming the rim of the plurality of second polygonal grooves may be omitted and include an open-type second polygonal groove which is open with another adjacent second polygonal groove.

In the present embodiment, two second polygonal grooves may be disposed adjacent to each other in a center of the pressure distribution portion, and a plurality of the open-type second polygonal grooves may be disposed adjacent to the two second polygonal grooves.

In the present embodiment, the first polygonal groove and the second polygonal groove may be formed in the same pattern with each other having a hexagonal shape.

In the present embodiment, a shape of the lower surface of the insole may have a round shape at the back and a square shape at the front, and the pressure distribution portion may be formed in a center portion of the lower surface.

In the present embodiment, the insole for shoes may further include a heel support portion that is formed to protrude in a rear rim of the upper surface of the insole. The heel support portion may include an inclination portion formed with a downward inclination of which an inclination degree is formed to be steep toward the front from the back of the insole.

In another embodiment, there is provided an ergonomic shoe including: a plurality of first polygonal grooves that are formed to be arranged in polygonal shapes on a lower surface of the shoe; a first wall portion forming a rim of the first polygonal groove; and a second polygonal groove that is disposed in a pressure distribution portion, which is a part of an inner and lower surface of the insole, and is formed of a rim including a second wall portion having a height lower than a height of the first wall portion.

Advantageous Effects

The insole for shoes according to an embodiment of the present disclosure includes the pressure distribution portion so that the pressure applied locally to the foot of the wearer can be distributed thereby improving the wearing comfort.

The insole for shoes according to an embodiment of the present disclosure includes the plurality of first and second polygonal grooves on the lower surface so that a honeycomb structure can be formed, thereby providing a strong and comfortable shoe insole.

In addition, since the pressure distribution portion of the insole is formed at a position biased from the center to the inner portion of the foot, the center point of the foot coming into contact with the ground can be mainly moved to the inner portion of the foot when the user walks while wearing the insole. That is, it is possible to bring both feet together in the direction of the inside of the foot during walking, provide a comfortable fit for users who wear the shoes mainly being worn out at the outer portion thereof due to poor gait, and at the same time, provide the effect of correcting the gait.

DETAILED DESCRIPTION OF THE EMBODIMENTS

Figure 1:
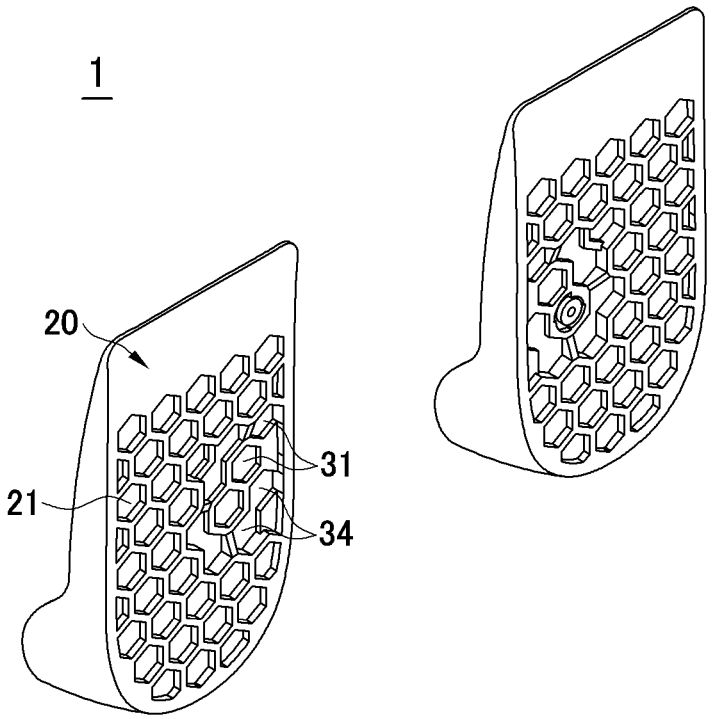
FIG. 1 is a perspective view illustrating a lower surface of a pair of shoe insoles according to an embodiment of the present disclosure.

Hereinafter, with reference to the accompanying drawings, embodiments of the present disclosure will be described in detail so that those of ordinary skill in the art can easily carry out the present disclosure. However, the present disclosure may be embodied in many different forms and is not limited to the embodiments described herein. In addition, in order to clearly explain the present disclosure in the drawings, portions irrelevant to the description are omitted, and similar reference numerals are attached to similar portions throughout the specification.

Throughout the specification, when a portion is said to be "connected" to another portion, it includes not only a case where it is "directly connected" but also a case where it is "electrically connected" with another element interposed therebetween. In addition, when a portion "includes" a certain component, this means that other components may be further included, rather than excluding the other components, unless otherwise stated.

Hereinafter, an ergonomic shoe insole according to an embodiment of the present disclosure will be described in detail with reference to the accompanying drawings. Meanwhile, the shoe insole will be mainly described below, but an embodiment of the present disclosure may be applied to a bottom surface of the shoe as well as the insole.

Figure 2:
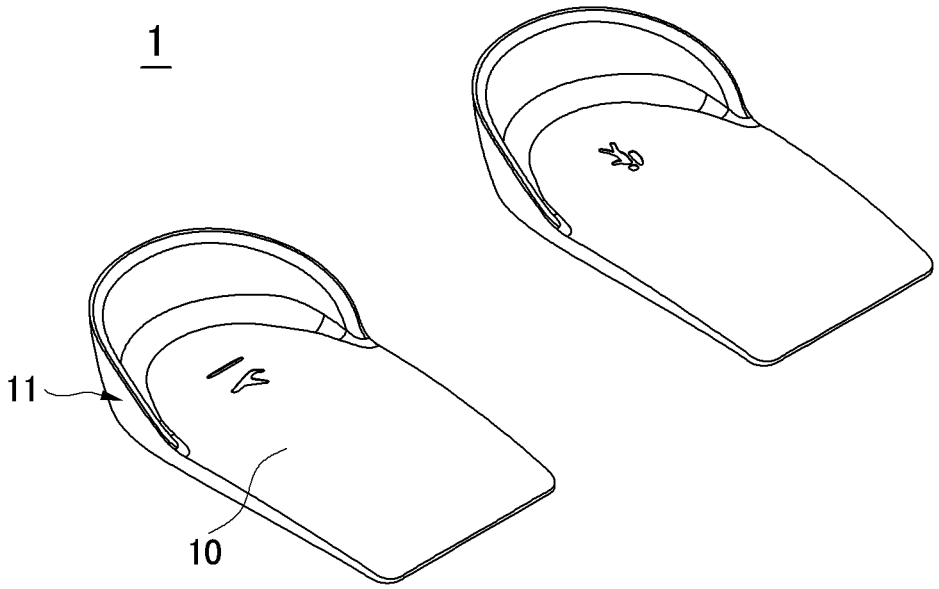
FIG. 2 is a perspective view illustrating an upper surface of the pair of shoe insoles according to an embodiment of the present disclosure.
Figure 3:
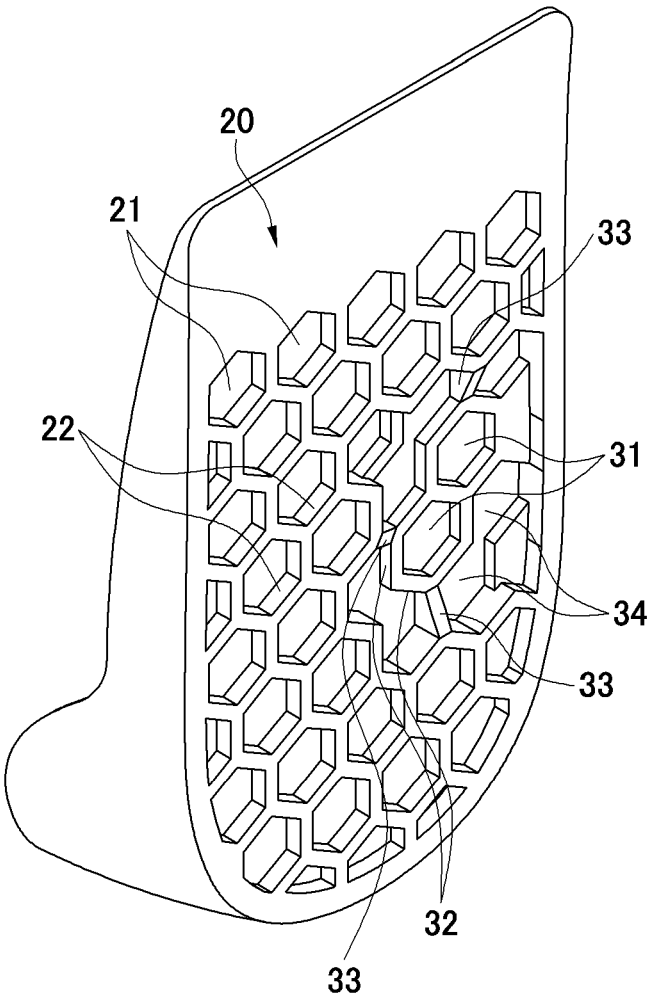
FIG. 3 is a perspective view illustrating the lower surface of the shoe insole according to an embodiment of the present disclosure.

FIG. 1 is a perspective view illustrating a lower surface 20 of a pair of shoe insoles 1 according to an embodiment of the present disclosure. FIG. 2 is a perspective view illustrating an upper surface 10 of the pair of shoe insoles 1 according to an embodiment of the present disclosure. FIG. 3 is a perspective view illustrating the lower surface 20 of the shoe insole 1 according to an embodiment of the present disclosure.

Referring to FIGS. 1 to 3, an overall shape of the shoe insole 1 according to an embodiment of the present disclosure is that a rear portion disposed adjacent to the heel of a user has a round shape, and a front portion that is disposed adjacent to an intermediate portion of the foot of the user may have a rectangular shape with rounded corners. Accordingly, the shape of the lower surface 20 of the insole may be similar to a shape (similar to a horseshoe shape) in which a horizontal straight line is drawn on an upper portion of the letter U.

Figure 4:
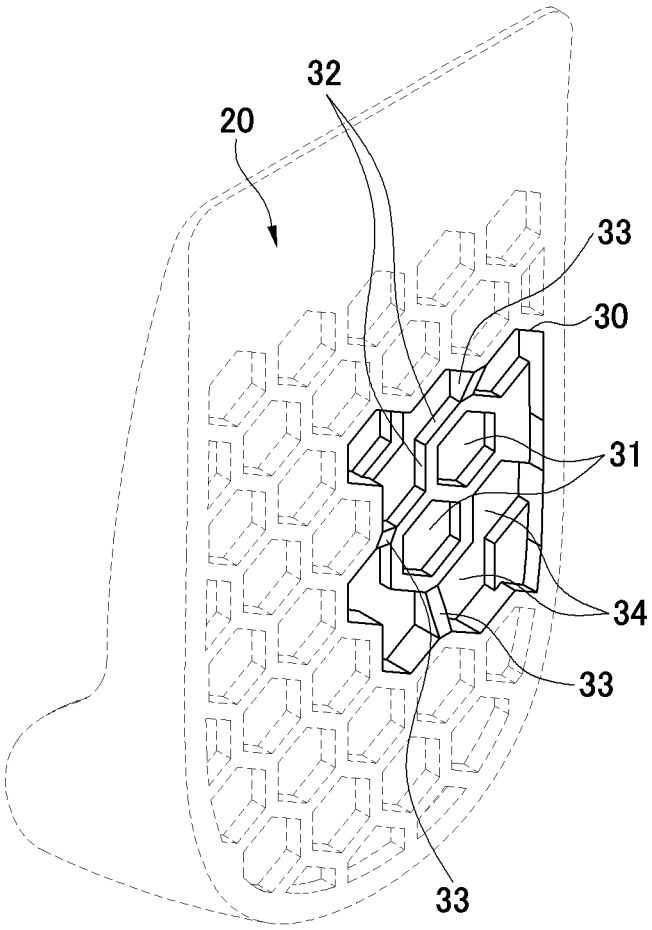
FIG. 4 is a perspective view illustrating a pressure distribution portion of the shoe insole according to an embodiment of the present disclosure.
Figure 5:
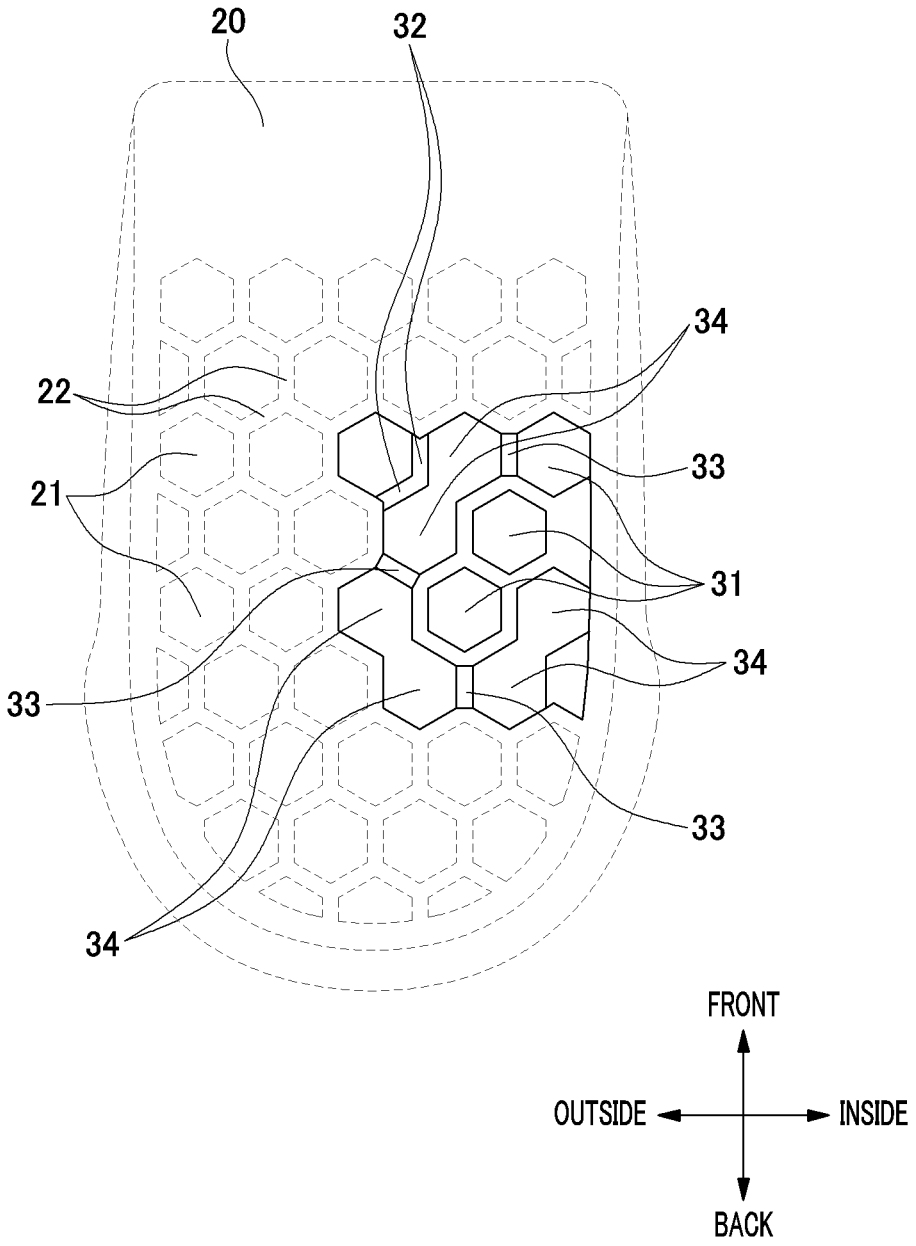
FIG. 5 is a bottom view illustrating a pressure distribution portion of the shoe insole according to an embodiment of the present disclosure.

FIG. 4 is a perspective view illustrating a pressure distribution portion 30 of the shoe insole 1 according to an embodiment of the present disclosure. FIG. 5 is a bottom view illustrating the pressure distribution portion 30 of the shoe insole 1 according to an embodiment of the present disclosure.

Further referring to FIGS. 4 and 5, the shoe insole 1 according to an embodiment of the present disclosure may include a first polygonal groove 21, a first wall portion 22, the pressure distribution portion 30, a second polygonal groove 31, a second wall portion 32, and a third wall portion 33.

The first polygonal grooves 21 may be a plurality of hexagonal grooves that are formed to be arranged in hexagonal shapes on the lower surface 20 of the insole. Five first polygonal grooves 21 may be laterally arranged side by side in the insole. The plurality of first polygonal grooves 21 may be arranged adjacent to each other on the lower surface 20 of the insole to have an overall honeycomb structure. In addition, the first polygonal groove 21 may have various shapes such as a pentagon, a heptagon, and an octagon, as well as the hexagonal shape. In addition, adjacent polygonal shapes may be the same shape, or may be different polygonal shapes.

Hereinafter, the first polygonal groove 21 will be described as an example having the hexagonal shape.

The first wall portion 22 may be a partition member forming a rim of the first polygonal groove 21. The plurality of first polygonal grooves 21 may be formed with one first wall portion 22 interposed therebetween. That is, the first polygonal grooves 21 may have a structure in which the first wall portion 22 is shared as one side of the hexagon.

In general, when a person walks, his/her weight is concentrated on the back and the outside of his/her foot. The pressure distribution portion 30 is a portion located on the inside of the foot and the concentration of the weight of the person is directed toward the pressure distribution portion 30, so that the load is distributed over the entire foot during walking. The pressure distribution portion 30 may be disposed on a part of the lower surface 20, which is formed on the inside of the insole. For example, the pressure distribution portion 30 may be formed in an inner center portion of the lower surface 20 of the insole. Referring to FIG. 5, a portion where the heel of the foot is disposed may be the back of the insole, the opposite side may be the front, and a portion where an outer edge (edge in a direction adjacent to the little toe) of the foot is disposed may be the outside of the insole, and a portion where an inside edge (edge in a direction adjacent to the big toe) of the foot may be the inside of the insole. That is, the pressure distribution portion 30 is disposed at a position slightly moved from the center of the insole in a lateral direction corresponding to the inner edge of the foot. According to the position and structure of the pressure distribution portion, the center of gravity of the foot may be moved toward the pressure distribution portion when the user walks. Accordingly, a force may be applied to the inner portion of the foot of the user, or the center of gravity may be moved to the inner portion of the foot during walking. Although many people have poor gait, it is often quite difficult to correct the gait. As an example, in a case where the gait is incorrect and the outside of the foot mainly come into contact the ground during walking, the surface corresponding to the outside of the bottom surface of the shoe may be quickly worn. In a case of providing these people with the structure of the insole or the bottom surface of the shoe of the present disclosure, it is possible to correct the bottom surface of the shoe coming into contact with the ground, thereby correcting the gait.

The second polygonal groove 31 is disposed in the pressure distribution portion 30 and may be a groove formed with a rim including the second wall portion 32 having a height lower than that of the first wall portion 22. The second polygonal groove 31 has a hexagonal shape and may be formed in the same pattern as the first polygonal groove 21. In addition, the second polygonal groove 31 may have various shapes, such as a pentagon, a heptagon, and an octagon, as well as the hexagonal shape.

Hereinafter, the second polygonal groove 31 will be described as an example having the hexagonal shape.

The second polygonal groove 31 may include the second wall portion 32 having the height lower than that of the first wall portion 22 to form a rim. In addition, the second polygonal groove 31 may be configured to include the third wall portion 33 that connects the first wall portion 22 and the second wall portion 32 to each other, and has an inclination decreasing from the height of the first wall portion 22 to the height of the second wall portion 32. For example, the second polygonal groove 31 may be formed by being surrounded by three first wall portions 22 and two second wall portions 32, and including the third wall portion 33 that connects the first wall portion 22 and the second wall portion 32. In addition, all six sides of the second polygonal groove 31 may be formed of the second wall portions 32.

In addition, in the pressure distribution portion 30, any one of the plurality of wall portions forming the rim of the plurality of second polygonal grooves 31 is omitted so that the open-type second polygonal groove 34, which is open with another adjacent second polygonal groove 31, may be formed. For example, the second wall portion 32 blocking two second polygonal grooves 31 may be omitted to form the open-type second polygonal groove 34 having a decagonal shape. As the wall portion is omitted, the hardness of the pressure distribution portion 30 is weakened, and when the weight of the wearer of the shoe is applied to the pressure distribution portion 30, the pressure distribution portion 30 may be more flexibly deformed.

In addition, the pressure distribution portion 30 may have a shape in which a number of the second polygonal grooves 31 and the open-type second polygonal grooves 34 are gathered as a whole. For example, two second polygonal grooves 31 may be disposed adjacent to each other in the center of the pressure distribution portion 30, and a plurality of the open-type second polygonal grooves 34 may be disposed adjacent to the two second polygonal grooves 31. In addition, the pressure distribution portion 30 may be formed by a combination of a total of four second polygonal grooves 31 and three open-type second polygonal grooves 34.

Figure 6:
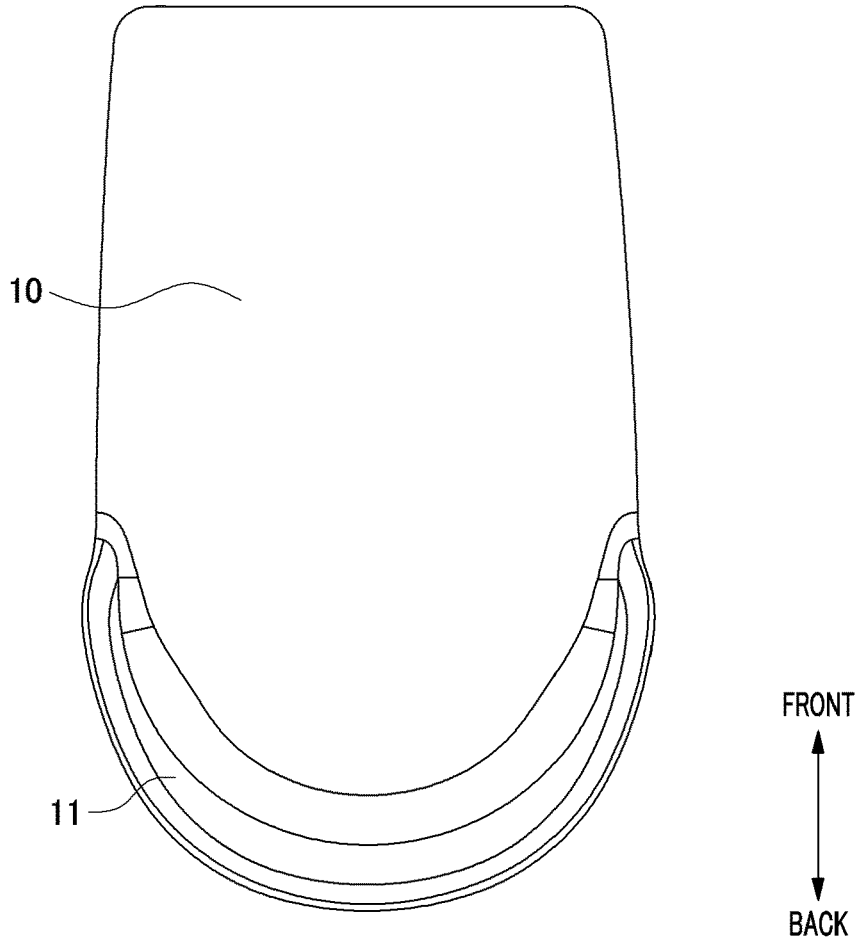
FIG. 6 is a plan view illustrating an upper surface of the shoe insole according to an embodiment of the present disclosure.
Figure 7:
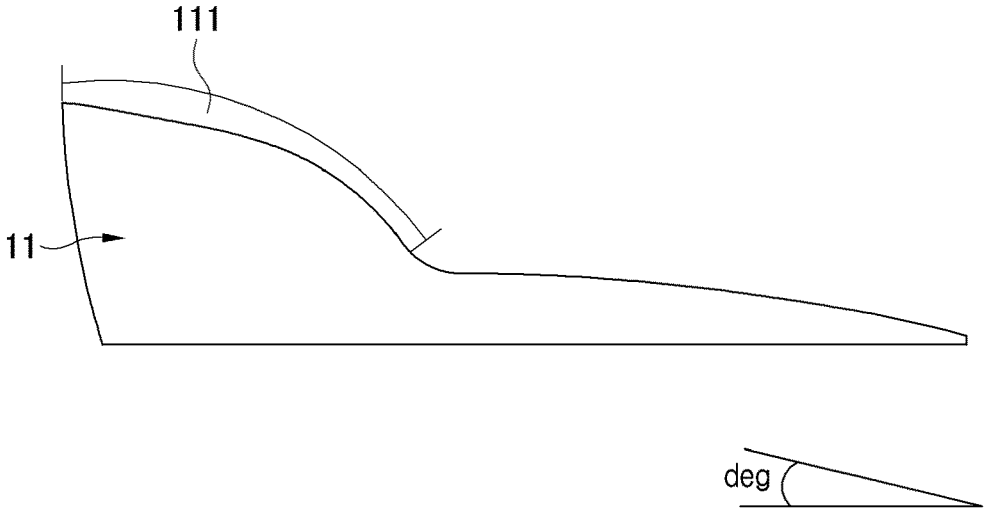
FIG. 7 is a side view illustrating a side surface of the shoe insole according to an embodiment of the present disclosure.

FIG. 6 is a plan view illustrating the upper surface 10 of the shoe insole 1 according to an embodiment of the present disclosure. FIG. 7 is a side view illustrating a side surface of the shoe insole 1 according to an embodiment of the present disclosure.

A heel support portion 11 may be formed on the upper surface 10 of the shoe insole 1 according to an embodiment of the present disclosure.

The heel support portion 11 may be formed to protrude from a back rim of the upper surface 10 of the insole to support the heel of the foot. The heel support portion 11 may include an inclination portion 111 that is inclined downward toward the front from the back of the insole.

The inclination portion 111 may be provided to mount the shoe insole 1 on the inner side of the shoe without any discomfort. In addition, an inclination degree of the inclination portion 111 may be formed to be steep toward the front from the back of the insole.

The upper surface 10 of the insole may be inclined downward toward the front from the back. Accordingly, the height of the insole decreases from the back to the front of the shoe, and the front of the insole has almost no difference in height with the inner bottom of the shoe, thereby improving the fit of the shoe.

As described above, the shoe insole 1 according to an embodiment of the present disclosure includes the pressure distribution portion 30 to distribute the pressure applied locally to the foot of the wearer to increase the fit of the shoe.

The shoe insole 1 according to an embodiment of the present disclosure includes the plurality of first polygonal grooves 21 and second polygonal grooves 31 on the lower surface 20 to form the honeycomb structure, so that a strong and comfortable shoe insole can be provided.

The above description is merely illustrative of the technical idea of the present disclosure, and various modifications and variations will be possible without departing from the essential characteristics of the present disclosure by those skilled in the art to which the present disclosure pertains. Therefore, the embodiments disclosed in the present disclosure are not intended to limit the technical spirit of the present disclosure, but to explain the technical spirit thereof, and the scope of the technical spirit of the present disclosure is not limited by these embodiments. The protection scope of the present disclosure should be construed by the following claims, and all technical ideas within the scope equivalent thereto should be construed as being included in the scope of the present disclosure.

What is claimed is:

1. An insole for ergonomic shoes comprising:

a plurality of first polygonal grooves that are formed to be arranged in polygonal shapes on a lower surface of the insole;

a first wall portion forming a rim of the first polygonal groove; and a second polygonal groove that is disposed in a pressure distribution portion, which is a part of an inner and lower surface of the insole, and is formed of a rim including a second wall portion having a height lower than a height of the first wall portion, wherein a plurality of the second polygonal grooves are formed, and wherein the rim in the plurality of second polygonal grooves further includes the first wall portion; and a third wall portion that connects the first wall portion and the second wall portion to each other, and has an inclination decreasing from the height of the first wall portion to the height of the second wall portion.

2. The insole for shoes of claim 1, wherein a plurality of the second polygonal grooves are formed, wherein any one of the plurality of wall portions forming the rim of the plurality of second polygonal grooves is omitted and includes an open-type second polygonal groove which is open with another adjacent second polygonal groove, and wherein two second polygonal grooves are disposed adjacent to each other in a center of the pressure distribution portion, and a plurality of the open-type second polygonal grooves are disposed adjacent to the two second polygonal grooves.

3. The insole for shoes of claim 1, wherein the first polygonal groove and the second polygonal groove are formed in the same pattern with each other having a hexagonal shape.

4. The insole for shoes of claim 1, wherein a shape of the lower surface of the insole has a round shape at the back and a square shape at the front, and the pressure distribution portion is formed in a center portion of the lower surface.

5. The insole for shoes of claim 1, further comprising:

a heel support portion that is formed to protrude in a rear rim of an upper surface of the insole, wherein the heel support portion includes an inclination portion formed with a downward inclination of which an inclination degree is formed to be steep toward the front from the back of the insole.

6. An ergonomic shoe comprising:

a plurality of first polygonal grooves that are formed to be arranged in polygonal shapes on a lower surface of the shoe;

a first wall portion forming a rim of the first polygonal groove; and a second polygonal groove that is disposed in a pressure distribution portion, which is a part of an inner and lower surface of an insole, and is formed of a rim including a second wall portion having a height lower than a height of the first wall portion, wherein a plurality of the second polygonal grooves are formed, and wherein the rim in the plurality of second polygonal grooves further includes the first wall portion; and a third wall portion that connects the first wall portion and the second wall portion to each other, and has an inclination decreasing from the height of the first wall portion to the height of the second wall portion.

* * * * *